US011346209B2

(12) United States Patent
Kyle et al.

(10) Patent No.: US 11,346,209 B2
(45) Date of Patent: May 31, 2022

(54) DOWNHOLE INTERVENTIONLESS DEPTH CORRELATION

(71) Applicant: Halliburton Energy Services, Inc., Houston, TX (US)

(72) Inventors: Donald G. Kyle, Plano, TX (US); Paul David Ringgenberg, Frisco, TX (US); Kenneth L. Schwendemann, Flower Mound, TX (US); Vincent Paul Zeller, Flower Mound, TX (US); Adam Harold Martin, Addison, TX (US); Kevin Michael Renkes, Dallas, TX (US); Nicholas Cole Ashford, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/631,211

(22) PCT Filed: Nov. 28, 2017

(86) PCT No.: PCT/US2017/063380
§ 371 (c)(1),
(2) Date: Jan. 15, 2020

(87) PCT Pub. No.: WO2019/108162
PCT Pub. Date: Jun. 6, 2019

(65) Prior Publication Data

US 2020/0284139 A1 Sep. 10, 2020

(51) Int. Cl.
*E21B 47/09* (2012.01)
*E21B 47/053* (2012.01)

(52) U.S. Cl.
CPC ..... *E21B 47/053* (2020.05); *E21B 47/09* (2013.01)

(58) Field of Classification Search
CPC ..... E21B 47/09; E21B 43/119; E21B 47/04; E21B 47/053
See application file for complete search history.

(56) References Cited

U.S. PATENT DOCUMENTS

| | | | | |
|---|---|---|---|---|
| 2,476,137 | A * | 7/1949 | Doll | E21B 43/119 166/254.1 |
| 4,137,452 | A | 1/1979 | Paap et al. | |
| 4,220,212 | A * | 9/1980 | Lands, Jr. | E21B 43/11857 175/4 |
| 4,788,436 | A | 11/1988 | Koechner | |
| 5,064,006 | A | 11/1991 | Waters et al. | |
| 5,285,065 | A | 2/1994 | Daigle et al. | |
| 6,028,534 | A | 2/2000 | Ciglenec et al. | |
| 6,037,585 | A | 3/2000 | Gadeken | |

(Continued)

FOREIGN PATENT DOCUMENTS

| | | |
|---|---|---|
| WO | WO 2014/089256 A1 | 6/2014 |
| WO | WO 2014/131132 A1 | 9/2014 |

OTHER PUBLICATIONS http://www.hexionfracline.com/summer2008/improveweilproduction.php.

(Continued)

*Primary Examiner* — Kipp C Wallace
(74) *Attorney, Agent, or Firm* — Haynes and Boone, LLP

(57) ABSTRACT

The present disclosure describes depth correlation tools and associated methods which do not require wireline depth correlation runs.

22 Claims, 7 Drawing Sheets

(56) References Cited

U.S. PATENT DOCUMENTS

| | | | | |
|---|---|---|---|---|
| 6,151,961 | A * | 11/2000 | Huber | E21B 41/00 73/152.54 |
| 6,736,210 | B2 | 5/2004 | Hosie et al. | |
| 8,637,826 | B2 | 1/2014 | Menge | |
| 8,759,749 | B2 | 6/2014 | Sinclair et al. | |
| 8,785,841 | B1 | 7/2014 | Stephenson et al. | |
| 9,784,095 | B2 * | 10/2017 | Echols, III | E21B 47/09 |
| 2002/0148611 | A1 * | 10/2002 | Williger | E21B 43/119 166/297 |
| 2009/0120637 | A1 | 5/2009 | Kirkwood et al. | |
| 2013/0008646 | A1 | 1/2013 | Blount | |
| 2013/0256032 | A1 | 10/2013 | Palmer | |
| 2013/0278432 | A1 | 10/2013 | Shashoua et al. | |
| 2014/0325828 | A1 | 11/2014 | Stoller | |
| 2014/0339409 | A1 | 11/2014 | Stephenson et al. | |
| 2015/0083410 | A1 | 3/2015 | Steele | |
| 2017/0159423 | A1 * | 6/2017 | Merino | E21B 47/12 |

OTHER PUBLICATIONS http://www.slb.com/services/completions/perforating/tubing_conveyed_perforating/accessories/radioactive_marker_sub.aspx.

International Search Report and The Written Opinion of the International Search Authority, or the Declaration, dated Sep. 27, 2018, PCT/US2017/063380, 16 pages, ISA/KR.

* cited by examiner

DOWNHOLE INTERVENTIONLESS DEPTH CORRELATION

PRIORITY

The present application is a U.S. National Stage patent application of International Patent Application No. PCT/US2017/063380, filed on Nov. 28, 2017, the benefit of which is claimed and the disclosure of which is incorporated herein by reference in its entirety.

FIELD OF THE DISCLOSURE

The present disclosure relates generally to downhole depth correlation and, more specifically, to systems and methods for performing interventionless depth correlation.

BACKGROUND

The need to accurately determine the position of tubing conveyances within a wellbore is essential to many downhole services. Conventionally, depth correlation requires a tubing conveyed downhole string first be deployed to a desired depth. Thereafter, an "intervention" is performed whereby the downhole operation is stopped and a wireline tool is conveyed inside the tubing string in order to obtain logs used to determine/confirm a position within the wellbore.

There are disadvantages to the conventional wireline interventions. First, the time required to set up and conduct a wireline intervention may take 12 to 24 hours. With estimated rig costs of upwards of $500,000 per day, such interventions are very costly. Moreover, there are blowout and other risks to personnel inherent in wireline runs.

DESCRIPTION OF ILLUSTRATIVE EMBODIMENTS

Figure 1:
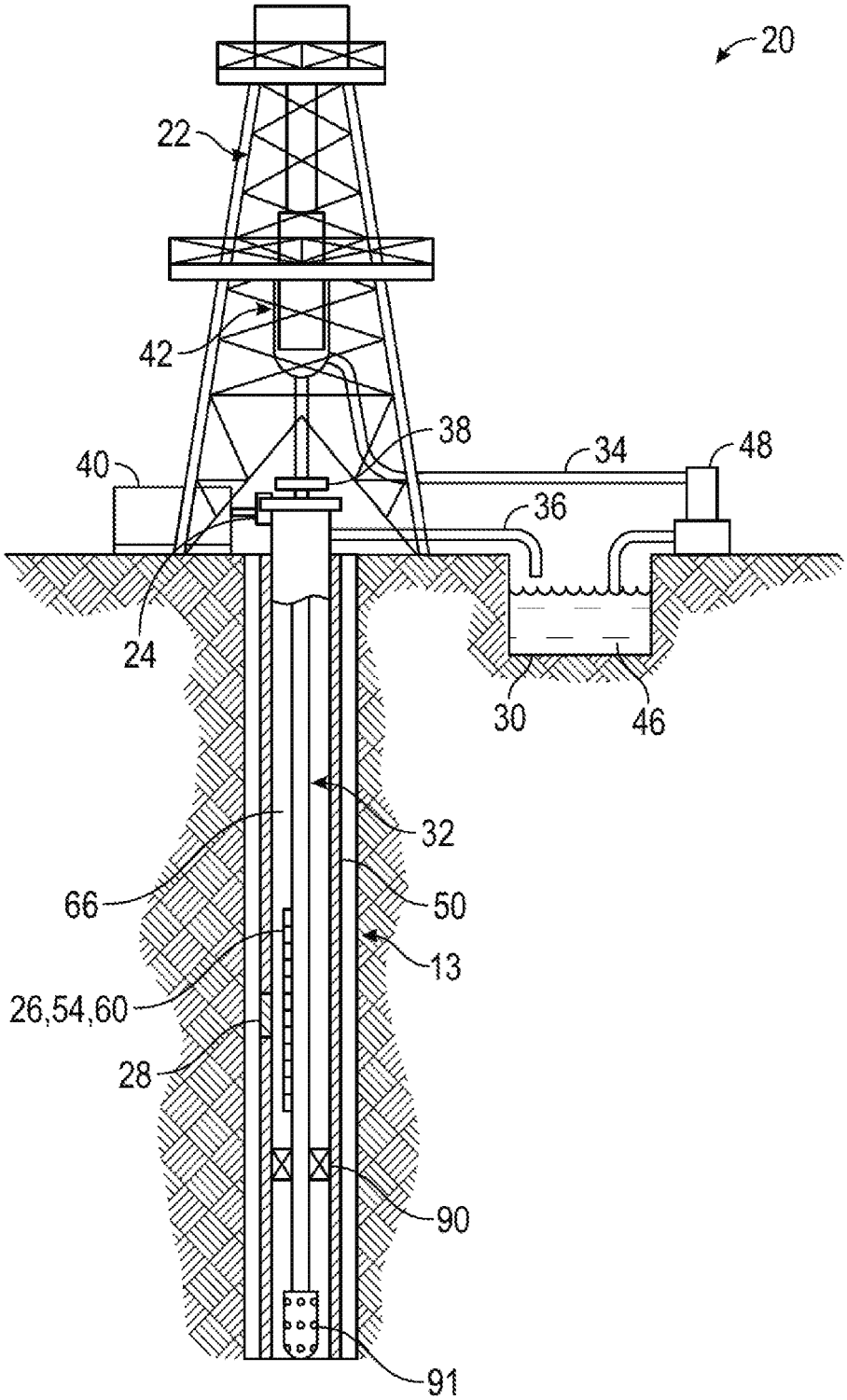
FIG. 1 illustrates a depth correlation system or the like according to one or more embodiments of the present disclosure.

Illustrative embodiments and related methods of the present disclosure are described below as they might be employed in systems and methods to perform interventionless depth correlation of downhole strings. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of this disclosure will become apparent from consideration of the following description and drawings.

As described herein, illustrative systems and methods of the present disclosure provide depth correlation techniques which do not require a wireline depth correlation run. In a first generalized embodiment, the depth of a fixed point in the casing is correlated to a fixed point in the tubing while the downhole string is held stationary at the surface. This stationary method involves deploying a downhole string along a wellbore. The downhole string includes a correlation sensor and a tool positioned thereon. While the downhole string is held stationary, positional data of a tag (e.g., radioactive tag located in the casing) is obtained using the correlation sensor. The position of the tag in relation to the correlation sensor is then determined using the positional data. Once this is known, the downhole string may be adjusted to position the tool (e.g., packer or perforating gun) at a desired depth based upon the known distance between the tool and correlation sensor. This method may be performed prior to setting the desired tool or used as a confirmation of depth after the tool is set at depth.

In a second generalized embodiment, the depth of a fixed point in the casing is correlated to a fixed point in the tubing while the downhole string is moving. This second dynamic method again involves deploying a downhole string along a wellbore to a terminal depth, the downhole string having a correlation sensor thereon including a nuclear sensor and an array of collar sensors. Once the terminal depth is reached, the correlation sensor is activated and moved towards a nuclear tag adjacent the wall of the wellbore (for example, in casing) until a peak signal is obtained from the nuclear sensor. Once the peak signal is obtained, the system then correlates which collar sensors are adjacent to casing collars. Using this correlation, the positions of the correlation sensor and tool(s) to be set at depth in relation to the tag are known. As the downhole string moves after the correlation, the system will then know the distance moved and may adjust the downhole string as necessary.

FIG. 1 illustrates a depth correlation system 20 or the like according to one or more embodiments of the present disclosure. System 20 may include a derrick or rig 22, which may be located on land, as illustrated, or atop an offshore platform, semi-submersible, drill ship, or any other suitable platform. Rig 22 may carry a downhole string 32, which may be a drill string, perforating string, or other tubular conveyance, for example. Rig 22 may be located proximate well head 24. Rig 22 may also include rotary table 38, rotary drive motor 40 and other equipment associated with rotation of drill string 32 within wellbore 13. For some applications rig 22 may include top drive motor or top drive unit 42. Blow out preventers (not expressly shown) and other equipment associated with drilling a wellbore 13 may also be provided at well head 24.

One or more pumps 48 may be used to pump drilling fluid 46 from fluid reservoir or pit 30 via conduit 34 to the uphole end of drill string 32 extending from well head 24. Annulus 66 is formed between the exterior of drill string 32 and the inside diameter of wellbore 13. The downhole end of drill string 32 may carry one or more downhole tools (e.g., packer 90 or perforating gun 91), which may also include a bottom hole assembly, mud motor, drill bit, fishing tool, sampler, sub, stabilizer, drill collar, tractor, telemetry device, logging device, or any other suitable tool(s). Drilling fluid 46 may flow through a longitudinal bore (not expressly shown) of drill string 32 and exit into wellbore annulus 66 via one or more ports. Conduit 36 may be used to return drilling fluid, reservoir fluids, formation cuttings and/or downhole debris from wellbore annulus 66 to fluid reservoir or pit 30. Various types of screens, filters and/or centrifuges (not expressly shown) may be provided to remove formation cuttings and other downhole debris prior to returning drilling fluid to pit 30.

Positioned along downhole string 32 is a correlation sensor 26 used to perform depth correlation of downhole string 32, according to certain illustrative embodiments of the present disclosure. In certain embodiments, correlation sensor 26 is composed of an array of 20 to 40 sensor modules spaced approximately 6 inches to 1 foot apart. However, in other embodiments, more or less sensor modules may be utilized. The sensor modules may consist of a photodiode or Geiger Muller tube (memory gamma sensor), for example, and an electronic control module. Each sensor module is communicably coupled together to a master control module which allows for individual access to each sensor module in order to create a gamma plot of the area of interest around the radioactive tag 28. In certain illustrative embodiments, tag 28 is located inside casing 50 or adjacent thereto (e.g., inside formation) at some known depth. Thus, in certain embodiments, the length of correlation sensor 26 is at least as long as the distance between casing collars. The gamma plot may then be communicated to the surface using a suitable wired or wireless communication technique, such as the wireless DynaLink® communications system.

During set up, correlation sensor 26 may be clamped onto downhole string 32 at a measured location from packer 90 or the top of perforating gun 91 (or any other desired tubing conveyed tool requiring positioning downhole). In general, when depth correlation of the tool string is desired, the communication systems would be used to activate correlation sensor 26. In certain illustrative embodiments, while downhole string 32 is stationary, correlation sensor 26 would then individually access each sensor module and request a gamma count. Correlation sensor 26 then plots the counts versus the known distances of each sensor module from one another. In other embodiments, however, the raw count data may be transmitted to the surface for processing. In certain embodiments, the correlation calculation is performed by sensor 26 and may include a non-linear interpolation of the location of tag 28 (e.g., if tag 28 is located between sensor modules and not directly adjacent to one specific sensor module). The resulting plot, along with the location of tag 28 within the plot, would then be transmitted to surface processing circuitry to correlate the exact location of tag 28 with the array of sensor modules forming correlation sensor 26. Once known, perforating gun 91, packer 90, or any other tool can be placed on depth based upon the known distance between the specific tool and correlation sensor 26.

Figure 2A:
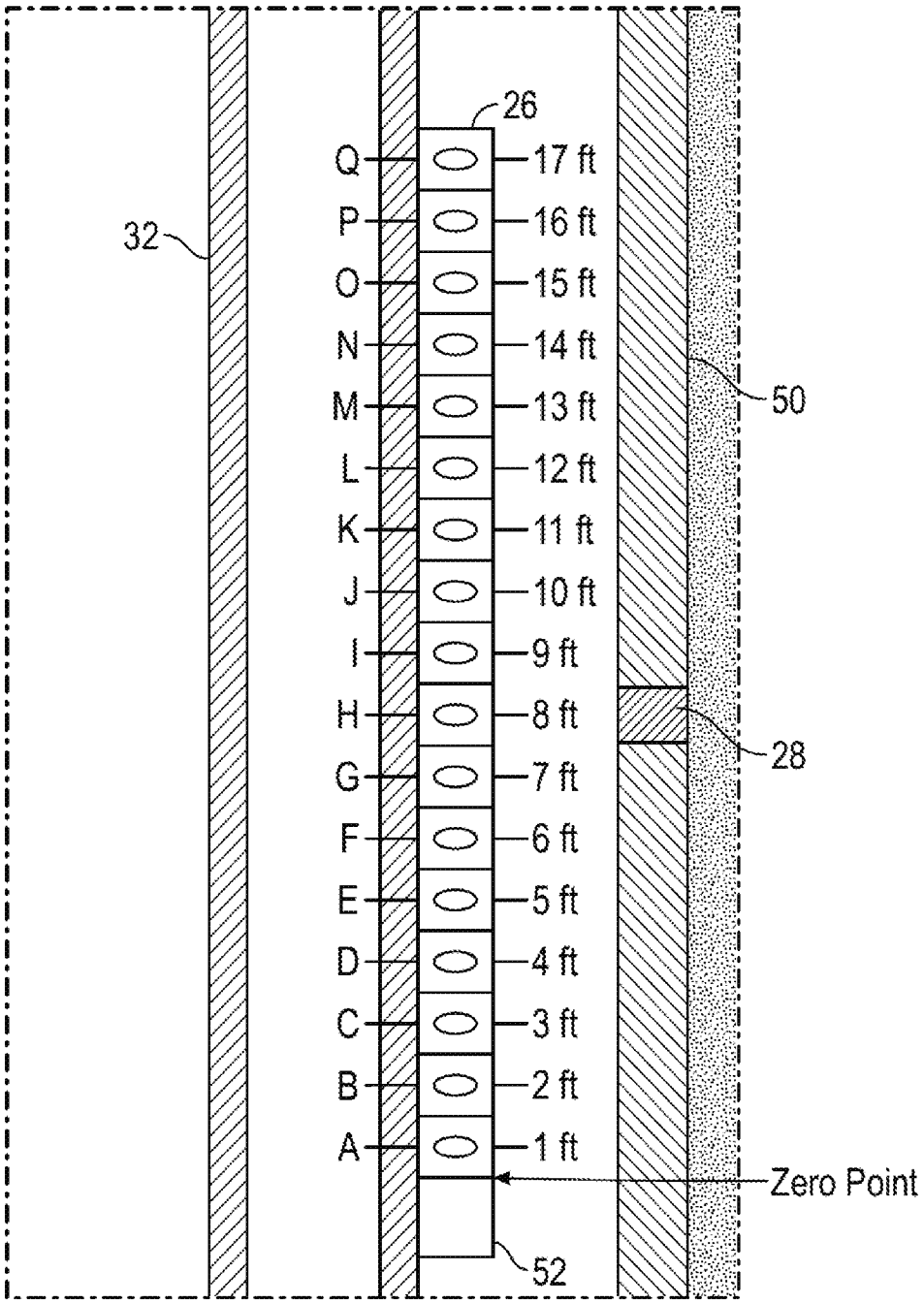
FIG. 2A is an exploded view of a correlation sensor, according to certain illustrative embodiments of the present disclosure.

FIG. 2A is an exploded view of correlation sensor 26, according to certain illustrative embodiments of the present disclosure. Correlation sensor 26 is illustrated as having an array of sensor modules A-Q positioned axially along sensor 26. A master control module 52 is communicably coupled to each of sensor modules A-Q in order to control selective activation and gamma count polling functions of each of the modules. As previously described, sensor modules A-Q may each include, for example, a gamma ray sensor to detect gamma rays emitted from tag 28. Master control module 52 comprises processing circuitry which may include at least one processor, a non-transitory, computer-readable memory, transceiver/network communication module, and optional I/O devices and user interface, all interconnected via a system bus. Software instructions executable by the processor for implementing the functions of the illustrative depth correlation described herein may be stored in memory.

In certain embodiments, the processing circuitry may be connected to one or more public and/or private networks via one or more appropriate network connections. It will also be recognized that the software instructions to perform the functions of the present disclosure may also be loaded into memory from a CD-ROM or other appropriate storage media via wired or wireless methods. Moreover, one or more of the processing functions of master control module 52 may also be performed remotely, such as at the surface.

Moreover, those ordinarily skilled in the art will appreciate that embodiments of this disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. This disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof in a computer system or other processing system.

As previously described, when downhole string 32 is made up, the distances between correlation sensor 26 and the various downhole tools being set to depth are known. For example, in FIG. 1, the distance between perforating gun 91 and correlation sensor 26 is known, as well as the distance between packer 90 and correlation sensor 26. The distance correlation sensor 26 has traveled from the surface is also known. In certain illustrative embodiments, the distance between the tools to be set at depth and correlation sensor 26 are measured from the zero point location (i.e., the position of sensor module A as indicated in FIG. 2A). From the zero point location, the distances to sensor modules B-Q are also known (in this example, each sensor module A-Q is evenly separated by 1 foot) as sensor module A-Q is separated by a predetermined distance. In addition, the position/depth of tag 28 is also known from the completion design phase. Thus, only the position of correlation sensor 26 in relation to tag 28 is unknown. Therefore, once the position of tag 28 in relation to correlation sensor 26 is known, downhole string 32 may be adjusted to position the tool (e.g., packer 90 or perforation gun 91) at the desired depth. Moreover, even after these tools have been set (e.g., packer 90 is set), the position of the tool may be confirm or monitored over time using correlation sensor 26.

Figure 2B:
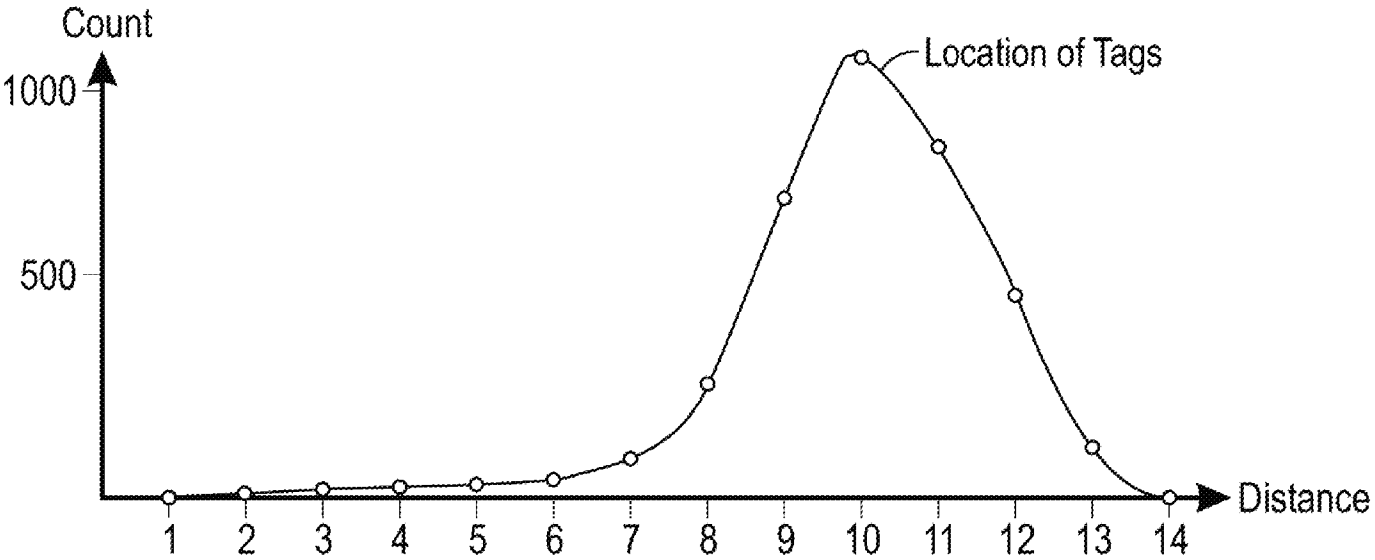
FIG. 2B illustrates a gamma plot generated according to certain illustrative embodiments of the present disclosure.

FIG. 2B illustrates a gamma plot generated according to certain illustrative embodiments of the present disclosure. As previously discussed, each sensor module A-Q is communicably coupled together to master control module 52 which allows for individual access to each sensor module in order to create a gamma plot of the area of interest around tag 28. When depth correlation is desired, master control module 52 polls each sensor module A-Q to obtain gamma counts and generates the plot accordingly. Alternatively, however, the raw data may be received and communicated uphole to surface processing circuitry whereby the plots are generated. In FIG. 2B, the gamma counts are plotted versus the sensor module (identified by the known distances of each sensor module A-Q from the zero point location adjacent master control module 52). For example, sensor module A may correspond to distance 1, sensor module B corresponds to distance 2, etc. Each distance represents some known measurement, such as inches, a foot, feet, etc. This gamma count data may also be referred to as positional data. In FIG. 2B, radioactive tag 28 has been identified as being positioned at sensor module 10 because the peak gamma signal is measured at this sensor module. Now, using this positional data of tag 28, master control module 52 knows the position of tag 28 in relation to correlation sensor 26. Since master control module also knows the distance between correlation sensor 26 and the bottom hole assembly tool (e.g., packer, perforation tool, etc.) to be set a depth, downhole string 32 can be adjusted accordingly to position the tool as desired.

In an alternative embodiment, sensor control module 52 may only activate select modules of sensor modules A-Q. For example, sensor control module 52 may only activate sensor modules F-J in FIG. 2A. In this way, the exact location of tag 28 could be communicated uphole as opposed to a gamma ray plot, thus eliminating the opportunity for human error in determining the depth based on the gamma plot. Alternatively, sensor control module 52 may calculate a non-linear interpolation of the position of tag 28 when its located between sensor modules. Moreover, the number and/or spacing between sensor modules A-Q may be designed to any desired resolution (e.g., inches).

Figure 2C:
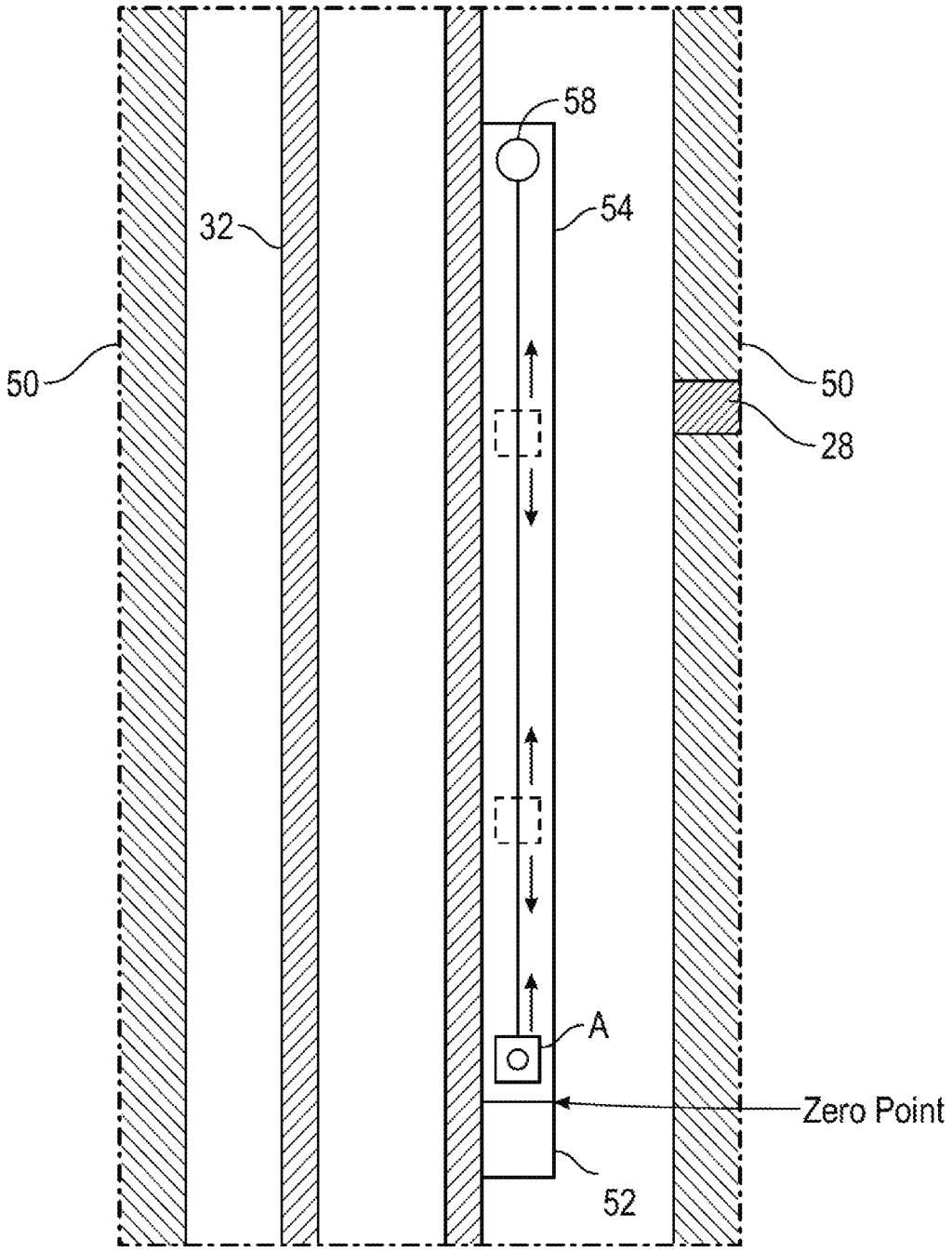
FIG. 2C illustrates an alternative embodiment of a depth correlation sensor, according to embodiments of the present disclosure.

FIG. 2C illustrates an alternative embodiment of a depth correlation sensor, according to embodiments of the present disclosure. In this example, correlation sensor 54 includes a single sensor module A which is axially moveable within sensor 54 along tubing 32. Correlation sensor 54 will also be clamped onto downhole string 32 at a measured location from the tool to be set (e.g., packer 90 or the top of perforating gun 91). In certain embodiments, the length of correlation sensor 54 is at least as long as the distance between casing collars. A variety of mechanisms may be used to move sensor module A including, for example, an electric driven motor or an annular pressure mechanism 58. In certain illustrative methods, during operation, sensor control module 52 (or remote processing circuitry) activates sensor module A to begin moving it up toward tag 28 while downhole string 32 remains stationary. Alternatively, however, sensor module A may be moved downwardly. Nevertheless, once activated, sensor module A begins obtaining gamma counts versus distance traveled from the zero point adjacent sensor control module 52, which again is plotted as shown in FIG. 2B. Once this local log is taken, the position of tag 28 is determined and the desired tool is set a depth based thereupon.

Figure 3:
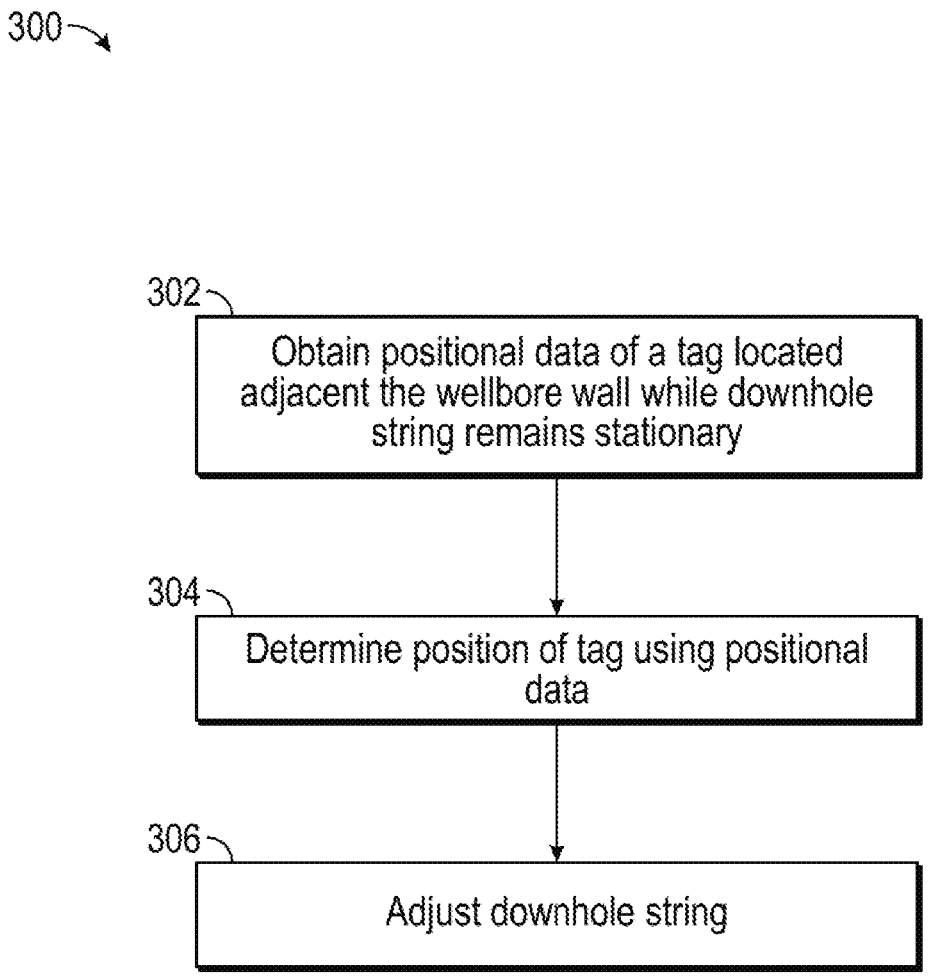
FIG. 3 is a flow chart of a method for stationary depth correlation, according to certain illustrative methods of the present disclosure.

FIG. 3 is a flow chart of a method for stationary depth correlation, according to certain illustrative methods of the present disclosure. At block 302 of method 300, a downhole string is deployed along a wellbore, the downhole string having a correlation sensor and a tool positioned thereon. With regard to correlation sensor 26, the array of sensor modules A-Q are individually polled to obtain positional data of a tag located adjacent a wall of the wellbore while the downhole string 32 remains stationary. With regard to correlation sensor 54, sensor module A is swept (or moved axially) the entire length of correlation sensor 54 while downhole string 32 remains stationary. At block 304, the position of the tag in relation to the correlation sensor 26,54 is determined. At block 306, the downhole string is adjusted accordingly to position the tool at a depth determined based upon a known distance between the tool and correlation sensor.

In yet other alternative embodiments of the present disclosure, the sensor modules discussed above may also include secondary sensors, such as magnetometers or casing collar locating sensors, to provide a secondary check as to the location of the radioactive tag. In many cases, the radioactive tag will be located within a collar or sub that can be distinguished by a magnetometer or collar locating sensor. The inclusion of a magnetometer or collar sensor in certain embodiments allows for confirmation of the tag location given by the gamma sensor(s), as well as a backup method of locating the tag in case the gamma sensor fails or otherwise functions improperly.

In other embodiments, an accelerometer can also be used within the sensor modules to provide information on any movement of the downhole string. Such data can be interpreted to calculate the distance the downhole string moves downhole to provide further confirmation of the location of the string relative to the radioactive tag.

With reference to FIGS. 1-2C, in yet another illustrative method of the present disclosure, after the tool has been set a depth, the correlation may be re-run to confirm the tool is set at the correct depth. For example, after packer 90 has been set, correlation sensor 26,54 may be re-activated to determine the position of tag 28, whereby the desired depth of the packer or gun 91 is then determined and compared with the actual set depth of the packer 90 or gun 91. Since the correlation can be performed without movement of downhole string 32, this can be achieve while packer 90 is set.

Figure 4:
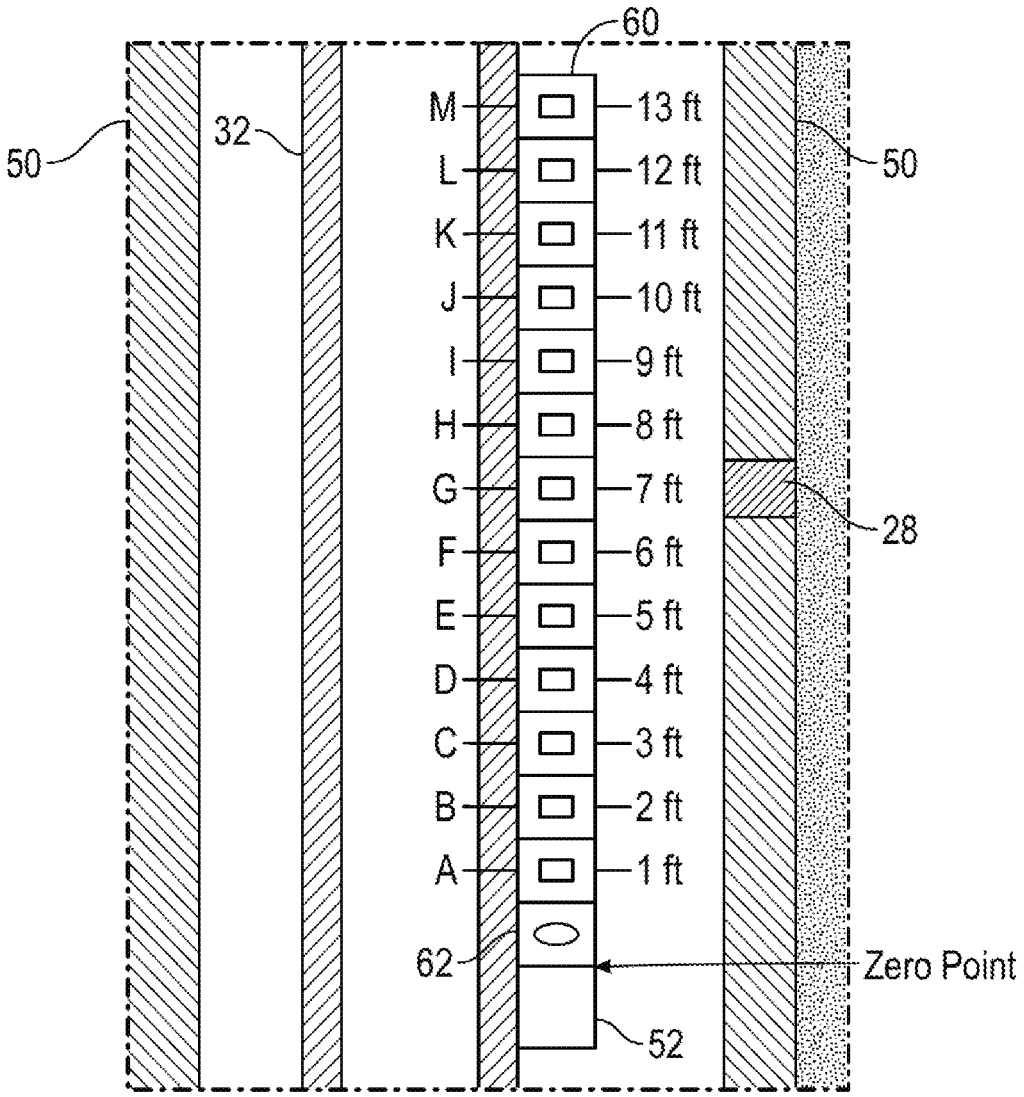
FIG. 4 illustrates an alternative illustrative embodiment of a correlation sensor, according to certain illustrative embodiments of the present disclosure.

FIG. 4 illustrates an alternative illustrative embodiment of the present disclosure. In FIG. 4, a correlation sensor 60 is illustrated having a sensor control module 52, a single gamma ray sensor 62, and a linear array of collar locating sensors A-M, such as micro-magnetometers. As previously discussed, correlation sensor 60 also may communicate with surface processing circuitry via a suitable communications protocol, such as, for example, the wireless DynaLink® communications system. As with previous embodiments described herein, the spacing between collar sensors A-M may be any desired length. However, at a minimum, some of collar sensors A-M will always be across a casing collar.

Collar sensors A-M will provide a specific output when adjacent to a casing collar. Each collar sensor will have a specific address so it can then be known which devices of the array are adjacent to a casing collar. As previously stated, the array will have some desired length, the minimum such that some magnetometers/sensor modules will always be across a casing collar. Alternatively, there may be multiple discrete devices across multiple casing collars. The exact length of correlation sensor 60 will be determined by the system design and possibly vary by each application in which the system is employed.

In certain embodiments, nuclear sensor 62 and collar sensors A-M will be on the same computer network (i.e., they function off the same clock signal). However, in other embodiments they will be on different networks (i.e., the function off a different clock signal). When they are on different networks, nuclear sensor 62 and collar sensors A-M must be synchronized when the terminal depth has been reached, but before correlation begins. The time that recorded events (i.e., signals obtained by nuclear sensor 62 and collar sensors A-M) occur will be required to properly position the desired tool (e.g., packer or perforating tool) at depth.

Surface installation of correlation sensor 60 will now be described. With reference to FIGS. 1 and 4, nuclear sensor 62 will be attached to downhole string 32 at a point so that it is proximate to a radioactive tag 28 that has been installed in casing 50. The position of nuclear sensor 62 in the bottom hole assembly will be determined by where radioactive tag 28 is located in the existing in ground casing string. In certain illustrative embodiments, when perforating gun 91 or packer 90 are near the required depth, nuclear sensor 62 must be below the tag of interest (there may be multiple tags 28 along casing 50) such that the tag can be found with a stand of pickup by the traveling blocks of the rig.

In the example illustrated in FIG. 4, locating adjacent to or near nuclear sensor 62 will be a networked array of collar sensors A-M. In correlation sensor 60, collar sensors A-M are axially positioned above gamma ray sensor 62 at 1 foot increments from the zero point (however, in alternative embodiments, more or less space may be between each sensor module A-M). However, in alternative embodiments, nuclear sensor 62 may be located above collar sensors A-M. Nevertheless, as the bottom hole assembly of downhole string 32 is assembled at the surface, physical measurements will be made to document a precise distance between the desired tool to be set at depth (e.g., packer 90 or gun 91) and nuclear sensor 62. The networked array of collar sensors A-M will be attached to the bottom hole assembly without the necessity of an exact distance between a reference point on correlation sensor 60 and nuclear sensor 62 or the desired tool to be set at depth.

During operation of one illustrative embodiment, correlation sensor 60 will be configured to record the time stamps when it traverses past all radioactive tags in the casing string. Correlation sensor 60 can also be configured to record the casing collars it encounters while running-in-hole ("RIH"), in certain other embodiments. In such embodiments, correlation sensor 60 may not be configured to record the formation background radiation, as this information will be unusable in most applications. As downhole string 32 is RIH, signals emitted from tags 28 and casing collars (not shown) are obtained by nuclear sensor 62 and collar sensors A-M, respectively, and transmitted by sensor control module 52 to surface processing circuitry for baseline information. In such an embodiment, correlation sensor 60 will be configured such that nuclear sensor 62 is below tag 28 once the terminal depth is reached, as shown in FIG. 4. Terminal depth refers to the desired depth at which correlation sensor 60 is deployed before being triggered to begin logging of signals from tag(s) 28.

Once the terminal depth has been reached, a signal will be sent to sensor control module 62 (from the surface, for example) to initiate a real-time clock synchronization between the memory PLT (i.e., nuclear sensor 62) or its equivalent and the system that powers the array of collar sensors A-M. As discussed above, such synchronization is only necessary if nuclear sensor 62 and collar sensors A-M are on different networks. When they are not, the two devices need to have the same time as this will be essential in determining the actual depth of the bottom hole assembly. In certain embodiments, this zero-point time may best be taken from a master device (e.g., within nuclear sensor 62 or control module 52), and the real-time clock of collar sensors A-M circuitry set to exactly match that of the master device.

During synchronization, collar sensors A-M will have some sensing modules which are adjacent to one or more casing collars. Any sensing module that is adjacent to a casing collar will have that signal recorded to memory with the synchronized real-time clock. Such sensing modules may be identified through comparison of their signals with those other sensing modules which are not adjacent casing collars. This data logging will begin when the real-time clock synchronization if effected (i.e., the zero point time) or may have some programmed time delay. When logging commences, it will continue for the duration of the depth correlation process whereby signals are obtained along with time stamps.

After the downhole string 32 has been deployed to the terminal depth, it will be pulled upward at a significantly slow rate to allow nuclear sensor 62 (as it moves closer to tag 28) to obtain radiation signals from tag 28 and write the detected radiation to memory at least twice for every foot of upward pipe movement, in certain illustrative embodiments. Writing more often to memory will enable a higher resolution, if desired, of the position of correlation sensor 60 relative to the tag 28 of interest. Downhole string 32 will continue to pull upwards until a peak signal is obtained by nuclear 60 from tag 28. The time at which the peak signal is received is referred to as the peak signal point time. In certain illustrative embodiments, the peak signal may be a pre-set signal of some threshold level.

Traversing downhole string 32 uphole through one full stand (approximately 90 ft) of distance will provide a plethora of data. In certain illustrative embodiments, the data may be processed by correlation sensor 60 to minimize the amount of information required to be transmitted to the surface. Nevertheless, in alternative embodiments, the entire dataset can be transmitted to surface processing circuitry and all processing take place there. If data is processed in correlation sensor 60, it will also be possible to receive additional data at the surface (e.g., temperature, pressure, etc.).

During this uphole travel of downhole string 32 in certain illustrative embodiments, it will not be critical to have a constant velocity. Since correlation sensor 60 logs each casing collar against time, a very fixed velocity will not be required. As nuclear sensor 62 is moved uphole and begins to approach tag 28, the radiation count level will begin to exceed a preset value/threshold. Each time a value of radiation counts is written to the memory of nuclear sensor 62, there will also be a timestamp associated with it. Thus, a record of the observed intensity of tag 28 versus time will be generated. Simultaneously, the array of collar sensors A-M will record which nodes/sensor modules in the array are adjacent to a casing collar with the real-timestamp.

At some point during the uphole travel of correlation sensor 60, nuclear sensor 62 will encounter a peak signal from tag 28 as mentioned above. Where this occurs in time is critical, as this time will be used to then correlate which collar sensors A-M are adjacent to casing collars (also referred to a "peak signal point time"). Those collar sensors A-M that are adjacent casing collars will read a maximum signal in comparison to other collar sensors in the array which are not adjacent casing collars. Once the correlation between collar sensors A-M and casing collars is known, the distance downhole string 32 moves as it is put into position to set packer 90 or guns 91, for example, will also be known. Therefore, correlation sensor 60 will then be able to effectively communicate to an operator any delta in distance the bottom hole assembly (e.g., sensor 60 and desired tools to be set a depth) has moved. As individual collar sensors A-M in the network array move past casing collars, those individual sensor modules in sensor A-M will log that event along with a timestamp. Therefore, correlation sensor 60 will only need to count the number of collar sensors A-M that have gone past casing collars since the peak signal point time in order to compute the distance the bottom hole assembly has moved since the peak signal point time. Thereafter, downhole string 32 may be adjusted accordingly.

Figure 5:
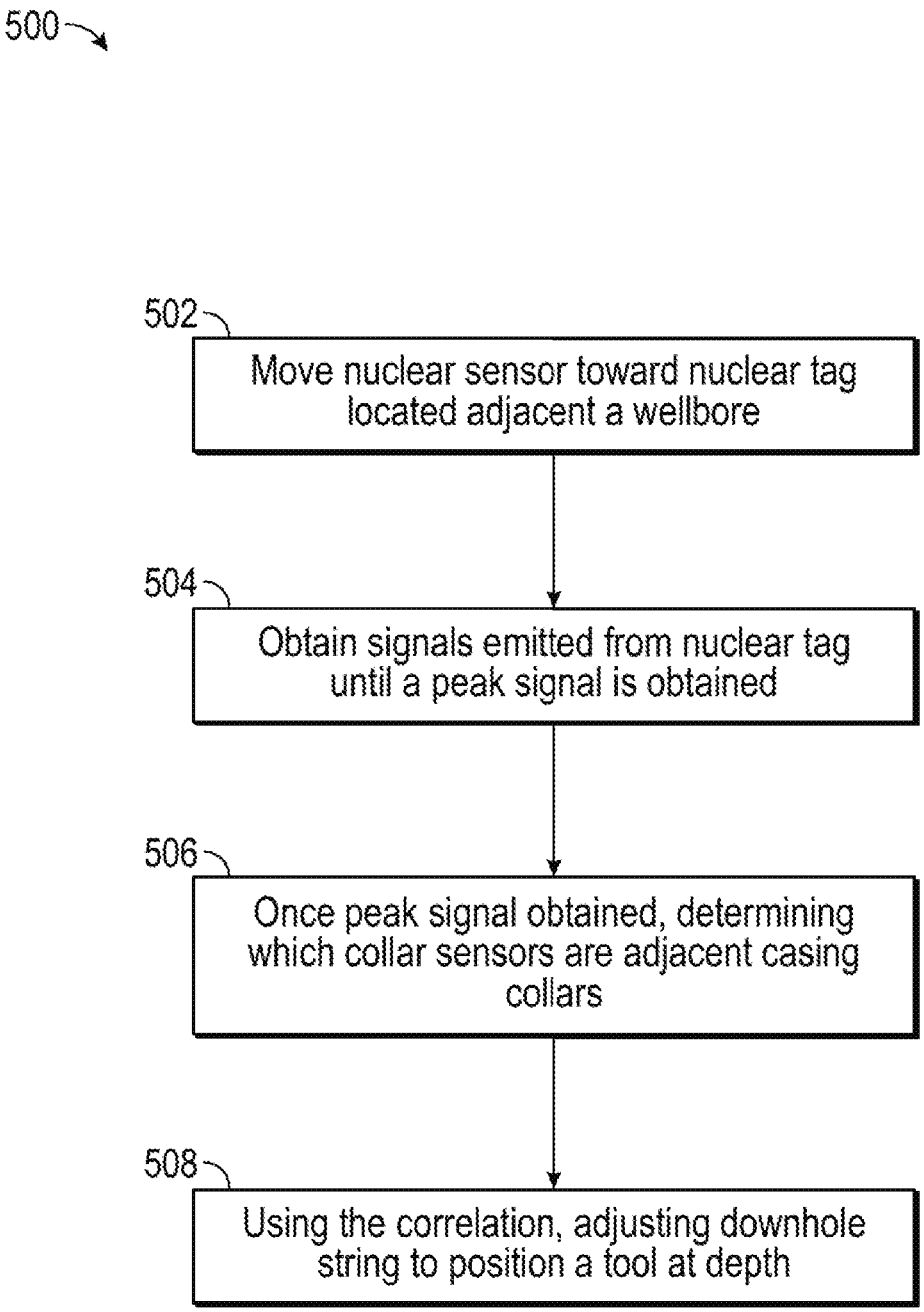
FIG. 5 is a flow chart of a depth correlation method using the embodiment of FIG. 4, according to certain illustrative methods of the present disclosure.

FIG. 5 is a flow chart of a depth correlation method, according to certain illustrative methods of the present disclosure. With reference to FIGS. 1, 4 and 5, at block 502, the downhole string having correlation sensor 60 thereon is deployed to a terminal depth. Once the terminal depth is reached, correlation sensor 60 is activated and moved toward tag 28. As nuclear sensor 62 moves closer to tag 28, the radiation being emitted from tag 28 is being measured as signals at sensor 62. The signals continue to be read until a peak signal is read, at block 504, also referred to as the peak signal point time. At block 506, correlation sensor 60 then determines which collar sensors A-M are adjacent casing collars at the peak signal point time. Then, using this correlation between collar sensors A-M and casing collars at the peak signal point time (and knowing the distance between the tools (e.g., packer 90 or gun 91) and collar sensors A-M), the downhole string 32 may be adjusted to position the those tools as desired, at block 508.

In certain illustrative methods, the position of tag 28 may be reconfirmed by correlation sensor 60. To do so, downhole string 32 is simply set back at the terminal depth, then moved towards tag 28 as described above. A peak signal will be obtained by nuclear sensor 62 at a second peak signal point time, where simultaneously a second correlation between casing collars and adjacent collar sensors A-M is determined. They system then compares the first correlation to this second correlation in order to confirm the correct position of tag 28. This confirmation method can be performed both before and after (to give the true depth packer was set at), thus alleviating any need for a wireline correlation run.

Accordingly, the illustrative depth correlation systems and methods described herein provide a number of advantages. All conventional known methods of performing depth correlation require surface pipe and/or wireline interventions, each of which require more time (12 to 24 hours) and expense (up to 500K/day). The embodiments described herein, however, provide systems that allow measurement of a bottom hole assembly location relative to a zone of interest in the well, which can be performed in as little as 5-6 hours. In certain embodiments, no manipulation of any equipment is required on the rig. Also, the embodiments described herein eliminate the need for a wireline correlation run prior to or after setting the packer (as done in conventional systems). This saves the customer a significant amount of time, as well as eliminating the risk inherent in wireline runs. The correlation systems of certain embodiments also allow the correlation to be re-run after the packer is set to confirm the perforating gun and/or packer is set at the correct depth, which can only be done via wireline intervention in conventional system.

Embodiments and methods of the present disclosure described herein further relate to any one or more of the following paragraphs:

1. A method for stationary depth correlation within a wellbore, the method comprising deploying a downhole string along the wellbore, the downhole string having a correlation sensor and a tool positioned thereon; using the correlation sensor, obtaining positional data of a tag located adjacent a wall of the wellbore while the downhole string remains stationary; using the positional data, determining a position of the tag in relation to the correlation sensor; and adjusting the downhole string to position the tool at a depth determined based upon a known distance between the tool and correlation sensor.

2. The method as defined in paragraph 1, wherein the tool is a packer; and the method further comprises setting the packer at the determined depth; and while the packer is set, obtaining second positional data of the tag using the correlation sensor while the downhole string remains stationary such that a depth of the packer is confirmed.

3. The method as defined in paragraphs 1 or 2, wherein the correlation sensor is a sensor array positioned axially along the downhole string; and obtaining the positional data comprises activation of individual sensors of the sensor array.

4. The method as defined in any of paragraphs 1-3, wherein the correlation sensor is an axially movable sensor positioned on the downhole string; and obtaining the positional data comprises activating the sensor; and moving the sensor axially along downhole string.

5. The method as defined in any of paragraphs 1-4, further comprising using a secondary sensor positioned along the downhole string to confirm a position of the tag.

6. A system for stationary depth correlation within a wellbore, the system comprising a correlation sensor positioned along a downhole string; a tool positioned along the downhole string, the tool being positioned a known distance from the correlation sensor; and processing circuitry communicably coupled to the correlation sensor to perform an operation comprising using the correlation sensor, obtaining positional data of a tag located adjacent a wall of the wellbore while the downhole string remains stationary; using the positional data, determining a position of the tag in relation to the correlation sensor; and adjusting the downhole string to position the tool at a depth determined based upon the known distance between the tool and correlation sensor.

7. The system as defined in paragraph 6, wherein the tool is a packer; and the processing circuitry is further adapted to perform an operation comprising setting the packer at the determined depth; and while the packer is set, obtaining second positional data of the tag using the correlation sensor while the downhole string remains stationary such that a depth of the packer is confirmed.

8. The system as defined in paragraphs 6 or 7, wherein the correlation sensor is a sensor array positioned axially along the downhole string; and obtaining the positional data comprises activation of individual sensors of the sensor array.

9. The system as defined in any of paragraphs 6-8, wherein the correlation sensor is an axially movable sensor positioned on the downhole string; and obtaining the positional data comprises activating the sensor; and moving the sensor axially along downhole string.

10. The system as defined in any of paragraphs 6-9, further comprising a secondary sensor used to confirm a position of the tag.

11. A method for depth correlation within a wellbore, the method comprising deploying a downhole string along the wellbore to a terminal depth, the downhole string having a correlation sensor and a tool positioned thereon, the correlation sensor comprising a nuclear sensor; and an array of collar sensors; once the terminal depth is reached, moving the downhole string such that the nuclear sensor moves toward a radioactive tag located adjacent a wall of the wellbore; as the nuclear sensor continues moving toward the radioactive tag, obtaining signals emitted from the radioactive tag using the nuclear sensor until a peak signal is obtained, a time at which the peak signal is obtained being a peak signal point time; at the peak signal point time, determining which collar sensors are located adjacent to casing collars, thereby determining a correlation; and using the correlation, adjusting the downhole string to position the tool at a depth determined based upon a known distance between the tool and array of collar sensors.

12. The method as defined in paragraph 11, wherein, once the terminal depth is reached, the method further comprises performing a clock synchronization of the gamma ray sensor and array of collar sensors.

13. The method as defined in paragraph 11 or 12, further comprising obtaining time stamps each time a signal is obtained by the nuclear sensor and each time the collar sensors detect a casing collar.

14. The method as defined in any of paragraphs 11-13, wherein using the correlation to adjust the downhole string comprises after the peak signal point time, counting a number of collar sensors which travel past a given casing collar; and based upon the number, determining how far the downhole string has moved since the peak signal point time, wherein the position of the tool may be adjusted accordingly.

15. The method as defined in any of paragraphs 11-14, further comprising moving the nuclear sensor back toward the radioactive tag again to obtain a second peak signal and second peak signal point time; at the second peak signal point time, determining which collar sensors are located adjacent to casing collars, thereby determining a second correlation; comparing the second correlation to the first correlation to thereby confirm a position of the downhole string in relation to the tag.

16. A system for depth correlation within a wellbore, the system comprising a correlation sensor positioned along a downhole string, the correlation sensor comprising a nuclear sensor and an array of collar sensors; a tool positioned along the downhole string; and processing circuitry communicably coupled to the correlation sensor to perform an operation comprising once a terminal depth is reached, moving the downhole string such that the nuclear sensor moves toward a radioactive tag located adjacent a wall of the wellbore; as the nuclear sensor continues moving toward the radioactive tag, obtaining signals emitted from the tag using the nuclear sensor until a peak signal is obtained, a time at which the peak signal is obtained being a peak signal point time; at the peak signal point time, determining which collar sensors are located adjacent to casing collars, thereby determining a correlation; and using the correlation, adjusting the downhole string to position the tool at a depth determined based upon a known distance between the tool and array of collar sensors.

17. The system as defined in paragraph 16, wherein, once the terminal depth is reached, the processing circuitry performs a clock synchronization of the gamma ray sensor and array of collar sensors.

18. The system as defined in paragraphs 16 or 17, wherein the processing circuitry performs the operation of obtaining time stamps each time a signal is obtained by the nuclear sensor and each time the collar sensors detect a casing collar.

19. The system as defined in any of paragraphs 16-18, wherein the operation of using the correlation to adjust the downhole string comprises after the peak signal point time, counting a number of collar sensors which travel past a given casing collar; and based upon the number, determining how far the downhole string has moved since the peak signal point time, wherein the position of the tool may be adjusted accordingly.

20. The system as defined in any of paragraphs 16-19, further comprising moving the nuclear sensor back toward the radioactive tag again to obtain a second peak signal and second peak signal point time; at the second peak signal point time, determining which collar sensors are located adjacent to casing collars, thereby determining a second correlation; comparing the second correlation to the first correlation to thereby confirm a position of the downhole string in relation to the tag.

Furthermore, the illustrative methods described herein may be implemented by a system comprising processing circuitry or a non-transitory computer readable medium comprising instructions which, when executed by at least one processor, causes the processor to perform any of the methods described herein.

Although various embodiments and methods have been shown and described, the present disclosure is not limited to such embodiments and methods and will be understood to include all modifications and variations as would be apparent to one skilled in the art. Therefore, it should be understood that this disclosure is not intended to be limited to the particular forms disclosed. Rather, the intention is to cover all modifications, equivalents and alternatives falling within the spirit and scope of the disclosure as defined by the appended claims.

What is claimed is:

1. A method for stationary depth correlation within a wellbore, the method comprising:

deploying a downhole string along the wellbore, the downhole string having a correlation sensor and a tool positioned thereon;

using the correlation sensor to sense a signal emitted from a tag located adjacent a wall of the wellbore while the downhole string remains stationary;

using the signal, determining a position of the tag in relation to the correlation sensor;

adjusting the downhole string to position the tool at a depth determined based upon a known distance between the tool and correlation sensor, wherein the correlation sensor is an axially movable sensor positioned on the downhole string; and sensing the signal comprises:

activating the sensor; and moving the sensor axially along downhole string.

2. The method as defined in claim 1, wherein:

the tool is a packer; and the method further comprises:

setting the packer at the determined depth; and while the packer is set, obtaining a second signal of the tag using the correlation sensor while the downhole string remains stationary such that a depth of the packer is confirmed.

3. The method as defined in claim 1, further comprising using a secondary sensor positioned along the downhole string to confirm a position of the tag.

4. A method for stationary depth correlation within a wellbore, the method comprising:

deploying a downhole string along the wellbore, the downhole string having a correlation sensor and a tool positioned thereon;

using the correlation sensor to sense a signal emitted from a tag located adjacent a wall of the wellbore while the downhole string remains stationary;

using the signal, determining a position of the tag in relation to the correlation sensor;

adjusting the downhole string to position the tool at a depth determined based upon a known distance between the tool and correlation sensor, wherein:

the correlation sensor is a sensor array positioned axially along the downhole string; and sensing the signal comprises activation of individual sensors of the sensor array such that data from less than all the individual sensors is obtained while the downhole string remains stationary.

5. The method as defined in claim 4, wherein:

the tool is a packer; and the method further comprises:

setting the packer at the determined depth; and while the packer is set, obtaining a second signal of the tag using the correlation sensor while the downhole string remains stationary such that a depth of the packer is confirmed.

6. The method as defined in claim 4, further comprising using a secondary sensor positioned along the downhole string to confirm a position of the tag.

7. A system for stationary depth correlation within a wellbore, the system comprising:

a correlation sensor positioned along a downhole string;

a tool positioned along the downhole string, the tool being positioned a known distance from the correlation sensor; and processing circuitry communicably coupled to the correlation sensor to perform an operation comprising:

using the correlation sensor to sense a signal emitted from a tag located adjacent a wall of the wellbore while the downhole string remains stationary;

using the signal, determining a position of the tag in relation to the correlation sensor;

adjusting the downhole string to position the tool at a depth determined based upon the known distance between the tool and correlation sensor, wherein the correlation sensor is an axially movable sensor positioned on the downhole string; and sensing the signal comprises:

activating the sensor; and moving the sensor axially along downhole string.

8. The system as defined in claim 7, wherein:

the tool is a packer; and the processing circuitry is further adapted to perform an operation comprising:

setting the packer at the determined depth; and while the packer is set, obtaining a second signal of the tag using the correlation sensor while the downhole string remains stationary such that a depth of the packer is confirmed.

9. The system as defined in claim 7, further comprising a secondary sensor used to confirm a position of the tag.

10. A system for stationary depth correlation within a wellbore, the system comprising:

a correlation sensor positioned along a downhole string;

a tool positioned along the downhole string, the tool being positioned a known distance from the correlation sensor; and processing circuitry communicably coupled to the correlation sensor to perform an operation comprising:

using the correlation sensor to sense a signal emitted from a tag located adjacent a wall of the wellbore while the downhole string remains stationary;

using the signal, determining a position of the tag in relation to the correlation sensor; and adjusting the downhole string to position the tool at a depth determined based upon the known distance between the tool and correlation sensor, wherein:

the correlation sensor is a sensor array positioned axially along the downhole string; and sensing the signal comprises activation of individual sensors of the sensor array such that data from less than all the individual sensors is obtained while the downhole string remains stationary.

11. The system as defined in claim 10, wherein:

the tool is a packer; and the processing circuitry is further adapted to perform an operation comprising:

setting the packer at the determined depth; and while the packer is set, obtaining a second signal of the tag using the correlation sensor while the downhole string remains stationary such that a depth of the packer is confirmed.

12. The system as defined in claim 10, further comprising a secondary sensor used to confirm a position of the tag.

13. A method for depth correlation within a wellbore, the method comprising:

deploying a downhole string along the wellbore to a terminal depth, the downhole string having a correlation sensor and a tool positioned thereon, the correlation sensor comprising:

a nuclear sensor; and an array of collar sensors;

once the terminal depth is reached, moving the downhole string such that the nuclear sensor moves toward a radioactive tag located adjacent a wall of the wellbore;

as the nuclear sensor continues moving toward the radioactive tag, obtaining signals emitted from the radioactive tag using the nuclear sensor until a peak signal is obtained, a time at which the peak signal is obtained being a peak signal point time;

at the peak signal point time, determining which collar sensors are located adjacent to casing collars, thereby determining a correlation; and using the correlation, adjusting the downhole string to position the tool at a depth determined based upon a known distance between the tool and array of collar sensors.

14. The method as defined in claim 13, wherein, once the terminal depth is reached, the method further comprises performing a clock synchronization of the gamma ray sensor and array of collar sensors.

15. The method as defined in claim 13, further comprising obtaining time stamps each time a signal is obtained by the nuclear sensor and each time the collar sensors detect a casing collar.

16. The method as defined in claim 13, wherein using the correlation to adjust the downhole string comprises:

after the peak signal point time, counting a number of collar sensors which travel past a given casing collar; and based upon the number, determining how far the downhole string has moved since the peak signal point time, wherein the position of the tool may be adjusted accordingly.

17. The method as defined in claim 13, further comprising:

moving the nuclear sensor back toward the radioactive tag again to obtain a second peak signal and second peak signal point time;

at the second peak signal point time, determining which collar sensors are located adjacent to casing collars, thereby determining a second correlation;

comparing the second correlation to the first correlation to thereby confirm a position of the downhole string in relation to the tag.

18. A system for depth correlation within a wellbore, the system comprising:

a correlation sensor positioned along a downhole string, the correlation sensor comprising a nuclear sensor and an array of collar sensors;

a tool positioned along the downhole string; and processing circuitry communicably coupled to the correlation sensor to perform an operation comprising:

once a terminal depth is reached, moving the downhole string such that the nuclear sensor moves toward a radioactive tag located adjacent a wall of the wellbore;

as the nuclear sensor continues moving toward the radioactive tag, obtaining signals emitted from the tag using the nuclear sensor until a peak signal is obtained, a time at which the peak signal is obtained being a peak signal point time;

at the peak signal point time, determining which collar sensors are located adjacent to casing collars, thereby determining a correlation; and using the correlation, adjusting the downhole string to position the tool at a depth determined based upon a known distance between the tool and array of collar sensors.

19. The system as defined in claim 18, wherein, once the terminal depth is reached, the processing circuitry performs a clock synchronization of the gamma ray sensor and array of collar sensors.

20. The system as defined in claim 18, wherein the processing circuitry performs the operation of obtaining time stamps each time a signal is obtained by the nuclear sensor and each time the collar sensors detect a casing collar.

21. The system as defined in claim 18, wherein the operation of using the correlation to adjust the downhole string comprises:

after the peak signal point time, counting a number of collar sensors which travel past a given casing collar; and based upon the number, determining how far the downhole string has moved since the peak signal point time, wherein the position of the tool may be adjusted accordingly.

22. The system as defined in claim 18, further comprising:

moving the nuclear sensor back toward the radioactive tag again to obtain a second peak signal and second peak signal point time;

at the second peak signal point time, determining which collar sensors are located adjacent to casing collars, thereby determining a second correlation; and comparing the second correlation to the first correlation to thereby confirm a position of the downhole string in relation to the tag.

* * * * *